US011785407B2

(12) United States Patent
Chon

(10) Patent No.: US 11,785,407 B2
(45) Date of Patent: Oct. 10, 2023

(54) METHOD AND APPARATUS FOR RENDERING SOUND SIGNAL, AND COMPUTER-READABLE RECORDING MEDIUM

(71) Applicant: SAMSUNG ELECTRONICS CO., LTD., Suwon-si (KR)

(72) Inventor: Sang-bae Chon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/571,589

(22) Filed: Jan. 10, 2022

(65) Prior Publication Data

US 2022/0132259 A1 Apr. 28, 2022

Related U.S. Application Data

(63) Continuation of application No. 17/115,120, filed on Dec. 8, 2020, now Pat. No. 11,245,998, which is a (Continued)

(51) Int. Cl.
*H04S 3/00* (2006.01)
*G10L 19/008* (2013.01)

(52) U.S. Cl.
CPC ..... *H04S 3/002* (2013.01); *G10L 19/008* (2013.01); *H04S 3/008* (2013.01); *H04S 2400/03* (2013.01);

(Continued)

(58) Field of Classification Search
None
See application file for complete search history.

(56) References Cited

U.S. PATENT DOCUMENTS 8,639,498 B2 1/2014 Beack et al.
9,549,275 B2 1/2017 Tsingos et al.
(Continued)

FOREIGN PATENT DOCUMENTS

CN 103369453 A 10/2013
EP 2 094 032 A1 8/2009
(Continued)

OTHER PUBLICATIONS

Anonymus, "ISO/IEC DIS 23008-3, Information technology—High efficiency coding media delivery in heterogeneous environments—Part 3: 3D audio," ISO/IEC JTC 1/SC29, Jul. 25, 2014, Total 433 pages, XP055298123, Retrieved from the Internet: URL:http://mpeg.chiariglione.org/standards/mpeg-h/3daudio/dismpeg-h-3d-audio.
(Continued)

*Primary Examiner* — Kenny H Truong
(74) *Attorney, Agent, or Firm* — Sughrue Mion, PLLC

(57) ABSTRACT

A method of reproducing a multi-channel audio signal including an elevation sound signal in a horizontal layout environment is provided, thereby obtaining a rendering parameter according to a rendering type and configuring a down-mix matrix, and thus effective rendering performance may be obtained with respect to an audio signal that is not suitable for applying virtual rendering. A method of rendering an audio signal includes receiving a multi-channel signal includes a plurality of input channels to be converted into a plurality of output channels; determining a rendering type for elevation rendering based on a parameter determined from a characteristic of the multi-channel signal; and rendering at least one height input channel according to the determined rendering type, wherein the parameter is included in a bitstream of the multi-channel signal.

7 Claims, 9 Drawing Sheets

Related U.S. Application Data continuation of application No. 16/851,903, filed on Apr. 17, 2020, now Pat. No. 10,873,822, which is a continuation of application No. 15/303,362, filed as application No. PCT/KR2015/003680 on Apr. 13, 2015, now Pat. No. 10,674,299.

(60) Provisional application No. 61/978,279, filed on Apr. 11, 2014.

(52) U.S. Cl.
CPC ..... *H04S 2420/01* (2013.01); *H04S 2420/03* (2013.01)

(56) References Cited

U.S. PATENT DOCUMENTS

| | | | |
|---|---|---|---|
| 10,304,466 | B2 | 5/2019 | Hatanaka et al. |
| 2008/0234244 | A1 | 9/2008 | Xie et al. |
| 2009/0006106 | A1 | 1/2009 | Pang et al. |
| 2010/0092014 | A1 | 4/2010 | Strauss et al. |
| 2011/0261966 | A1 | 10/2011 | Engdegard |
| 2012/0008789 | A1 | 1/2012 | Kim et al. |
| 2012/0033816 | A1 | 2/2012 | Lee et al. |
| 2012/0213375 | A1 | 8/2012 | Mahabub et al. |
| 2012/0314875 | A1 | 12/2012 | Lee et al. |
| 2013/0148812 | A1 | 6/2013 | Corteel et al. |
| 2013/0259236 | A1 | 10/2013 | Chon et al. |
| 2014/0133683 | A1 | 5/2014 | Robinson et al. |
| 2014/0334626 | A1 | 11/2014 | Lee et al. |
| 2015/0154965 | A1 | 6/2015 | Wuebbolt et al. |
| 2015/0194158 | A1 | 7/2015 | Oh et al. |
| 2015/0223002 | A1 | 8/2015 | Mehta et al. |
| 2016/0044434 | A1 | 2/2016 | Chon et al. |

FOREIGN PATENT DOCUMENTS

| | | | |
|---|---|---|---|
| EP | 2 595 149 | A2 | 5/2013 |
| EP | 3 079 379 | A1 | 10/2016 |
| JP | 2007-533213 | A | 11/2007 |
| JP | 2011-66868 | A | 3/2011 |
| JP | 2012-513138 | A | 6/2012 |
| JP | 2013/533703 | A | 8/2013 |
| JP | 2014-520491 | A | 8/2014 |
| KR | 10-2008-0089308 | A | 10/2008 |
| KR | 10-2013-0080819 | A | 7/2013 |
| KR | 10-2015-0083734 | A | 7/2015 |
| RU | 2 406 166 | C2 | 12/2010 |
| RU | 2 439 719 | C2 | 1/2012 |
| RU | 2 485 605 | C2 | 6/2013 |
| RU | 2 510 906 | C2 | 4/2014 |
| WO | 2011/102967 | A1 | 8/2011 |
| WO | 2012/125855 | A1 | 9/2012 |
| WO | 2013/006338 | A2 | 1/2013 |
| WO | 2014/007096 | A1 | 1/2014 |
| WO | 2014/013070 | A1 | 1/2014 |
| WO | 2014/021588 | A1 | 2/2014 |
| WO | 2014/036121 | A1 | 3/2014 |
| WO | 2014/157975 | A1 | 10/2014 |
| WO | 2015/147530 | A1 | 10/2015 |

OTHER PUBLICATIONS

"Text of ISO/IEC 23008-3/DIS, 3D audio," 109. MPEG Meeting; Jul. 7, 2014-Jul. 11, 2014 Sapporo;(Motion Picture Expert Group or ISO/IEC JTC1/SC29/11), No. n14747, [retrieved Aug. 2014, Total 435 pages, XP030021482, Retrieved from the Internet: URL:http://phenix.int-evry.fr/mpeg/doc_end_user/documents/109_Sapporo/wg11/w14747-v2-w14747.zip ISOIEC_23008-3_(E)_(DIS of 3DA).docx.

Communication dated Apr. 29, 2021, issued by the European Patent Office in counterpart European Application No. 15776195.8.

Communication dated Dec. 30, 2019 issued by the Indian Patent Office in Indian counterpart Application No. 201627034613.

Communication dated Dec. 6, 2017, issued by the Russian Patent Office in counterpart Russian application No. 2016144175.

Communication dated Feb. 25, 2021, issued by the Korean Patent Office in counterpart Korean Patent Application No. 2016-7031015.

Communication dated Jan. 22, 2018, issued by the Australian Patent Office in counterpart Australian Patent Application No. 2015244473.

Communication dated Jul. 26, 2019, issued by the Australian Patent Office in counterpart Australian Application No. 2018208751.

Communication dated Jul. 30, 2019, issued by the Japanese Patent Office in counterpart Japanese Application No. 2018-146255.

Communication dated Jun. 25, 2019, issued by the Russian Patent Office in counterpart Russian Application No. 2018145487.

Communication dated Nov. 10, 2017, issued by the Mexican Patent Office in counterpart Mexican application No. MX/a/2016/013352.

Communication dated Nov. 23, 2017, issued by the State Intellectual Property Office of China in counterpart Chinese application No. 201580030824.6.

Communication dated Nov. 9, 2017, issued by the European Patent Office in counterpart European application No. 15776195.8.

Communication dated Oct. 31, 2017, issued by the Japanese Patent Office in counterpart Japanese application No. 2017-505030.

Communication dated Aug. 8, 2017 by the Canadian Intellectual Property Office in counterpart Canadian Patent Application No. 2,945,280.

Communication dated Jun. 23, 2017 by the Australian Patent Office in counterpart Australian Patent Application No. 2015244473.

Communication dated Mar. 31, 2020 by the Brazilian Patent Office in counterpart Brazilian Patent Application No. BR1120160237161.

Communications dated Jul. 9, 2018 by the State Intellectual property Office of China in counterpart Chinese Patent Application No. 201580030824.6.

International Search Report dated Jul. 7, 2015 issued by International Searching Authority in counterpart International Application No. PCT/KR2015/003680.

ISO/IEC JTC 1/SC 29 N ISO/IEC CD 23008-3, "Information technology—High efficiency coding and media delivery in heterogeneous environments—Part 3: 3D audio", Apr. 4, 2014, XP055206371, 337 pages total.

ITU-R, BS.2159-0, "Multichannel sound technology in home and broadcasting applications", May 18, 2010, 34 pages total, http://.itu.int/pub/R-REP-BS.2159.

Alexander Krueger et al, "Corrections for DIS text of ISO IEC 23008-3 3D Audio," 111. MPEG Meeting; Feb. 16, 2015-Feb. 20, 2015; Geneva; (Motion Picture Expert Group or ISO/IEC JTC1/SC29/WG11), No. m35907, retrieved Feb. 11, 2015, XP030270831, Total 449 pages, Retrieved from the Internet:URL:http://phenix.intevry.fr/mpeg/doc_end_user/documents/111_Geneva/wg11/m35907-v1-m35907_DISCorrections.zip ISOIEC_23008-3_(E)_(DIS of 3DA)_Corrections.docx.

Notice of Allowance issued in prior U.S. Appl. No. 16/851,903 dated Aug. 21, 2020.

Written Opinion dated Jul. 7, 2015 issued by International Searching Authority in counterpart International Application No. PCT/KR2015/003680.

Young Woo Lee, et al, "Virtual Height Speaker Rendering for Samsung 10.2-Channel Vertical Surround System", Oct. 23, 2011, Audio Engineering Society Convention Paper 8523 Presented at the 131st Convention, 10 pages total.

Notice of Allowance issued in parent U.S. Appl. No. 17/115,120 dated Oct. 20, 2021.

Communication dated Apr. 17, 2023, issued by European Patent Office in European Application No. 15776195.8.

Communication dated Feb. 20, 2023, issued by Indian Patent Office in Indian Application No. 202228075077.

Communication dated May 30, 2023, issued by the Korean Intellectual Property Office in Korean Patent Application No. 10-2022-7014138.

FIG. 6

| Syntax | . . . . | No. ofbits | Mnemonic |
|---|---|---|---|
| RenderingTypeConfig() | | | |
| { | | | |
| rendering3DType; | | 1 | uimsbf |
| } | | | |

METHOD AND APPARATUS FOR RENDERING SOUND SIGNAL, AND COMPUTER-READABLE RECORDING MEDIUM

CROSS-REFERENCE TO RELATED APPLICATION

This is a Continuation Application of U.S. application Ser. No. 17/115,120, filed Dec. 8, 2020, which is a Continuation Application of U.S. application Ser. No. 16/851,903, filed Apr. 17, 2020 (now U.S. Pat. No. 10,873,822), which is a Continuation Application of U.S. application Ser. No. 15/303,362, filed Oct. 11, 2016 (now U.S. Pat. No. 10,674,299), which is a National Stage Entry of International Application No. PCT/KR2015/003680 filed April 13, 2015, which claims priority to U.S. Provisional Application No. 61/978,279 filed on Apr. 11, 2014, the contents of all of which are incorporated by reference herein in their entireties.

TECHNICAL FIELD

The present invention relates to a method and apparatus for rendering an audio signal and, more specifically, to a rendering method and apparatus for down-mixing a multi-channel signal according to a rendering type.

BACKGROUND ART

Owing to developments in image and sound processing technology, a large quantity of high image and sound quality content has been produced. Users who demand high image and sound quality content want realistic images and sound, and thus research into stereoscopic image and stereophonic sound has been actively conducted.

A stereophonic sound indicates a sound that gives a sense of ambience by reproducing not only a pitch and a tone of the sound but also a three-dimensional (3D) direction including horizontal and vertical directions and a sense of distance, and having additional spatial information by which an audience, who is not located in a space where a sound source is generated, is made aware of a sense of direction, a sense of distance, and a sense of space.

When a multi-channel signal, such as 22.2 channel signal, is rendered as a 5.1 channel signal by using a virtual rendering technology, a 3D stereophonic sound can be reproduced by means of a two-dimensional (2D) output channel.

DETAILED DESCRIPTION OF THE INVENTION

Technical Problem

When a multi-channel signal, such as a 22.2 channel signal, is rendered as a 5.1 channel signal by using a virtual rendering technology, although three-dimensional (3D) audio signals can be reproduced by using a two-dimensional (2D) output channel, it may not be suitable for applying virtual rendering according to characteristics of signals.

The present invention relates to a method and apparatus for reproducing stereophonic sound and, more specifically, to a method of reproducing a multi-channel audio signal including an elevation sound signal in a horizontal layout environment, thereby obtaining a rendering parameter according to a rendering type and configuring a down-mix matrix.

Technical Solution

The representative configuration of the present invention to achieve the purpose described above is as follows.

According to an aspect of an embodiment, a method of rendering an audio signal includes receiving a multi-channel signal comprising a plurality of input channels to be converted into a plurality of output channels; determining a rendering type for elevation rendering based on a parameter determined from a characteristic of the multi-channel signal; and rendering at least one height input channel according to the determined rendering type, wherein the parameter is included in a bitstream of the multi-channel signal.

Advantageous Effects of the Invention

When a multi-channel signal, such as a 22.2 channel signal, is rendered as a 5.1 channel signal by using a virtual rendering technology, although three-dimensional (3D) audio signals can be reproduced by means of a two-dimensional (2D) output channel, it may not be suitable for applying virtual rendering according to characteristics of signals.

The present invention relates to a method of reproducing a multi-channel audio signal including an elevation sound signal in a horizontal layout environment, thereby obtaining a rendering parameter according to a rendering type and configuring a down-mix matrix, and thus effective rendering performance may be obtained with respect to an audio signal that is not suitable for applying virtual rendering.

DESCRIPTION OF THE DRAWINGS

FIG. 6 illustrates a syntax that determines a rendering type configuration based on a rendering type determination parameter, according to an embodiment.

BEST MODE

Figure 1:
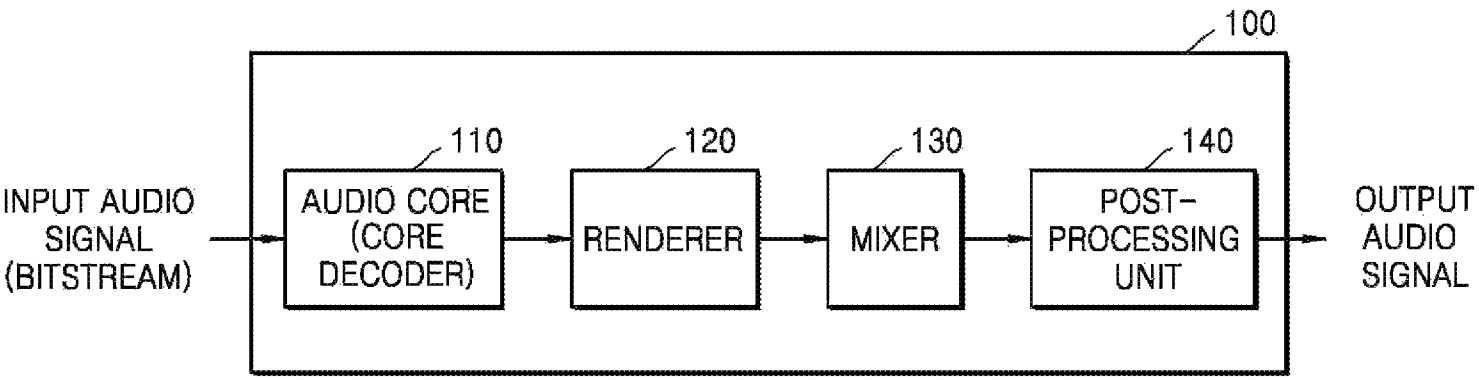
FIG. 1 is a block diagram illustrating an internal structure of a stereophonic audio reproducing apparatus according to an embodiment.

The representative configurations of the present invention to achieve the purpose described above are as follows.

According to an aspect of an embodiment, a method of rendering an audio signal includes receiving a multi-channel signal comprising a plurality of input channels to be converted into a plurality of output channels; determining a rendering type for elevation rendering based on a parameter determined from a characteristic of the multi-channel signal; and rendering at least one height input channel according to the determined rendering type, wherein the parameter is included in a bitstream of the multi-channel signal.

The multi-channel signal may be decoded by a core decoder.

The determining of the rendering type may include: determining the rendering type for each of frames of the multi-channel signal.

The rendering of the at least one height input channel may include: applying different down-mix matrixes obtained according to the determined rendering type, to the at least one height input channel.

The method may further include: determining whether to perform virtual rendering on an output signal, wherein, if the output signal is not virtually rendered, the determining of the rendering type comprises: determining the rendering type not to perform elevation rendering.

The rendering may include: performing spatial tone color filtering on the at least one height input channel, if the determined rendering type is a three-dimensional (3D) rendering type, performing spatial location panning on the at least one height input channel; and if the determined rendering type is a two-dimensional (2D) rendering type, performing general panning on the at least one height input channel.

The performing of the spatial tone color filtering may include: correcting a tone color of sound based on a head related transfer function (HRTF).

The performing of the spatial location panning may include: generating an overhead sound image by panning the multi-channel signal.

The performing of the general panning may include: generating a sound image on a horizontal plane by panning the multi-channel signal based on an azimuth angle.

The parameter may be determined based on an attribute of an audio scene.

The attribute of the audio scene may include at least one of correlation between channels of an input audio signal and a bandwidth of the input audio signal.

The parameter may be created at an encoder.

According to an aspect of another embodiment, an apparatus for rendering an audio signal includes a receiving unit for receiving a multi-channel signal comprising a plurality of input channels to be converted into a plurality of output channels; a determining unit for determining a rendering type for elevation rendering based on a parameter determined from a characteristic of the multi-channel signal; and a rendering unit for rendering at least one height input channel according to the determined rendering type, wherein the parameter is included in a bitstream of the multi-channel signal.

The apparatus may further include: a core decoder, wherein the multi-channel signal is decoded by the core decoder.

The determining unit may determine the rendering type for each of frames of the multi-channel signal.

The rendering unit may apply different down-mix matrixes obtained according to the determined rendering type to the at least one height input channel.

The apparatus may further include: a determining unit for determining whether to perform virtual rendering on an output signal, wherein, if the output signal is not virtually rendered, the determining unit determines the rendering type not to perform elevation rendering.

The rendering unit may perform spatial tone color filtering on the at least one height input channel, if the determined rendering type is a 3D rendering type, further perform spatial location panning on the at least one height input channel, and if the determined rendering type is a 2D rendering type, further perform general panning on the at least one height input channel.

The spatial tone color filtering may correct a tone color of sound based on a head related transfer function (HRTF).

The spatial location panning may generate an overhead sound image by panning the multi-channel signal.

The general panning may generate a sound image on a horizontal plane by panning the multi-channel signal based on an azimuth angle.

The parameter may be determined based on an attribute of an audio scene.

The attribute of the audio scene may include at least one of correlation between channels of an input audio signal and a bandwidth of the input audio signal.

The parameter may be created at an encoder.

According to an aspect of another embodiment, a computer-readable recording medium has recorded thereon a program for executing the method described above.

Also, another method and another system for implementing the present invention, and a computer-readable recording medium having recorded thereon a computer program for executing the method are further provided.

MODE OF THE INVENTION

The detailed description of the present invention to be described below refers to the accompanying drawings showing, as examples, specific embodiments by which the present invention can be carried out. These embodiments are described in detail so as for those of ordinary skill in the art to sufficiently carry out the present invention. It should be understood that various embodiments of the present invention differ from each other but do not have to be exclusive to each other.

For example, a specific shape, structure, and characteristic set forth in the present specification can be implemented by being changed from one embodiment to another embodiment without departing from the spirit and the scope of the present invention. In addition, it should be understood that locations or a layout of individual components in each embodiment also can be changed without departing from the spirit and the scope of the present invention. Therefore, the detailed description to be described is not for purposes of limitation, and it should be understood that the scope of the present invention includes the claimed scope of the claims and all scopes equivalent to the claimed scope.

Like reference numerals in the drawings denote the same or like elements in various aspects. Also, in the drawings, parts irrelevant to the description are omitted to clearly describe the present invention, and like reference numerals denote like elements throughout the specification.

Hereinafter, embodiments of the present invention will be described in detail with reference to the accompanying drawings so that those of ordinary skill in the art to which the present invention belongs can easily carry out the present invention. However, the present invention can be implemented in various different forms and is not limited to the embodiments described herein.

Throughout the specification, when it is described that a certain element is 'connected' to another element, this includes a case of "being directly connected" and a case of "being electrically connected" via another element in the middle. In addition, when a certain part "includes" a certain component, this indicates that the part may further include another component instead of excluding another component unless there is specially different disclosure.

Hereinafter, the present invention is described in detail with reference to the accompanying drawings.

FIG. 1 is a block diagram illustrating an internal structure of a stereophonic audio reproducing apparatus 100 according to an embodiment.

The stereophonic audio reproducing apparatus 100 according to an embodiment may output a multi-channel audio signal in which a plurality of input channels are mixed to a plurality of output channels to be reproduced. In this case, if the number of output channels is less than the number of input channels, the input channels are down-mixed to meet the number of output channels.

A stereophonic sound indicates a sound having a sense of ambience by reproducing not only a pitch and a tone of the sound but also a direction and a sense of distance, and having additional spatial information by which an audience, who is not located in a space where a sound source is generated, is aware of a sense of direction, a sense of distance, and a sense of space.

In the description below, output channels of an audio signal may indicate the number of speakers through which a sound is output. The greater the number of output channels, the greater the number of speakers through which a sound is output. According to an embodiment, the stereophonic audio reproducing apparatus 100 may render and mix a multi-channel acoustic input signal to output channels to be reproduced so that a multi-channel audio signal having a greater number of input channels can be output and reproduced in an environment having a smaller number of output channels. In this case, the multi-channel audio signal may include a channel in which an elevated sound can be output.

The channel in which an elevated sound can be output may indicate a channel in which an audio signal can be output by a speaker located above the heads of an audience so that the audience senses elevation. A horizontal channel may indicate a channel in which an audio signal can be output by a speaker located on a horizontal surface to the audience.

The above-described environment having a smaller number of output channels may indicate an environment in which a sound can be output by speakers arranged on the horizontal surface with no output channels via which an elevated sound can be output.

In addition, in the description below, a horizontal channel may indicate a channel including an audio signal which can be output by a speaker located on the horizontal surface. An overhead channel may indicate a channel including an audio signal which can be output by a speaker located on an elevated position above the horizontal surface to output an elevated sound.

Referring to FIG. 1, the stereophonic audio reproducing apparatus 100 according to an embodiment may include an audio core 110, a renderer 120, a mixer 130, and a post-processing unit 140.

According to an embodiment, the stereophonic audio reproducing apparatus 100 may output channels to be reproduced by rendering and mixing multi-channel input audio signals. For example, the multi-channel input audio signal may be a 22.2 channel signal, and the output channels to be reproduced may be 5.1 or 7.1 channels. The stereophonic audio reproducing apparatus 100 may perform rendering by determining an output channel to correspond to each channel of the multi-channel input audio signal and mix rendered audio signals by synthesizing signals of channels corresponding to a channel to be reproduced and outputting the synthesized signal as a final signal.

An encoded audio signal is input to the audio core 110 in a bitstream format. The audio core 110 decodes the input audio signal by selecting a decoder tool suitable for a scheme by which the audio signal was encoded. The audio core 110 may be used to have the same meaning as a core decoder.

The renderer 120 may render the multi-channel input audio signal to a multi-channel output channel according to channels and frequencies. The renderer 120 may perform three-dimensional (3D) rendering and 2D rendering of a multi-channel audio signal, including overhead channel and horizontal channel. A configuration of the renderer and a specific rendering method will be described in more detail with reference to FIG. 2.

The mixer 130 may output a final signal by synthesizing signals of channels corresponding to the horizontal channel by the renderer 120. The mixer 130 may mix signals of channels for each set section. For example, the mixer 130 may mix signals of channels for each I frame.

According to an embodiment, the mixer 130 may perform mixing based on power values of signals rendered to respective channels to be reproduced. In other words, the mixer 130 may determine an amplitude of the final signal or a gain to be applied to the final signal based on the power values of the signals rendered to the respective channels to be reproduced.

The post-processing unit 140 performs a dynamic range control and binauralizing of a multi-band signal for an output signal of the mixer 130 to meet each reproducing device (speaker or headphone). An output audio signal output from the post-processing unit 140 is output by a device such as a speaker, and the output audio signal may be reproduced in a 2D or 3D manner according to processing of each component.

The stereophonic audio reproducing apparatus 100 according to the embodiment of FIG. 1 is shown based on a configuration of an audio decoder, and a subsidiary configuration is omitted.

Figure 2:
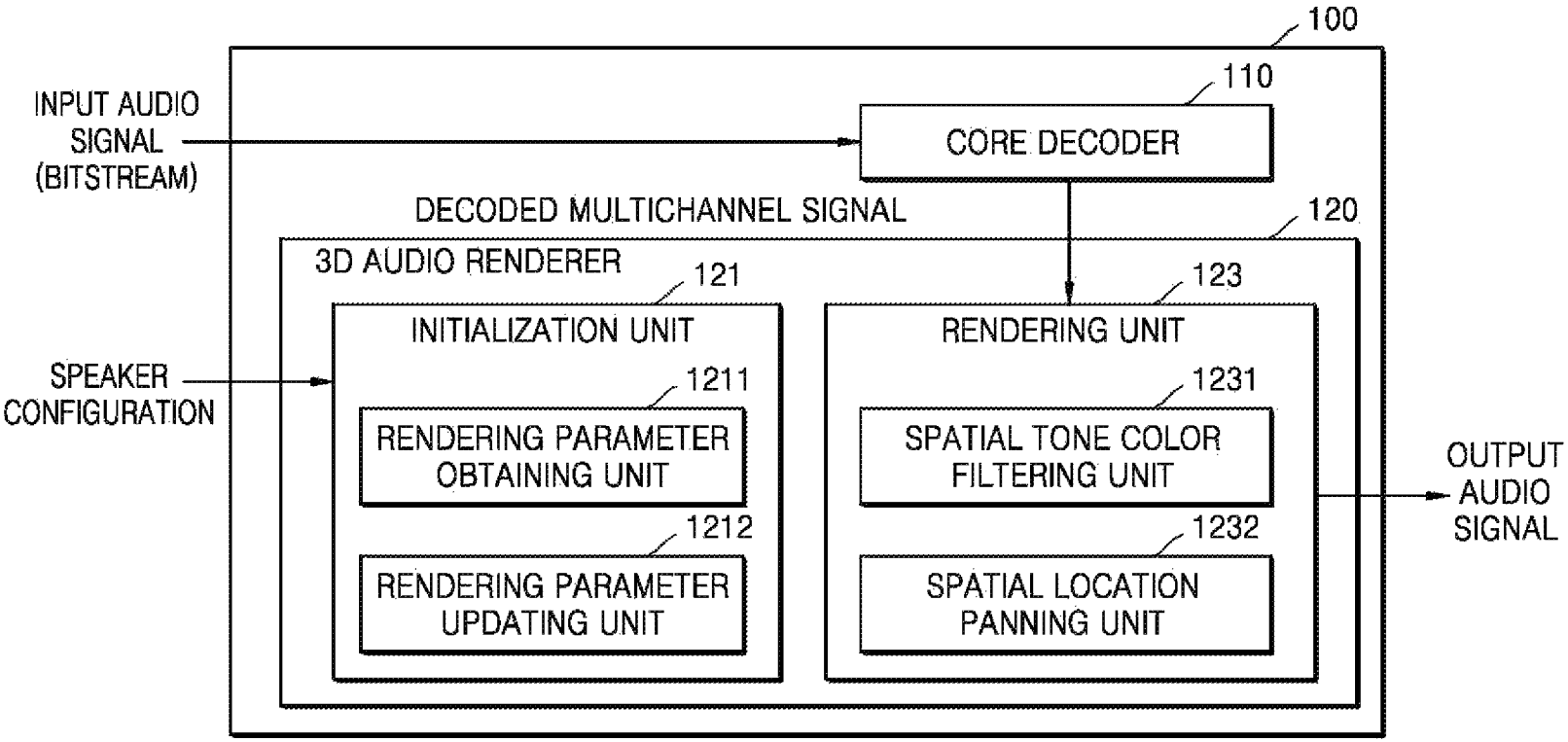
FIG. 2 is a block diagram illustrating a configuration of a decoder and a three-dimensional (3D) acoustic renderer in the stereophonic audio reproducing apparatus according to an embodiment.

FIG. 2 is a block diagram illustrating a configuration of the core decoder 110 and the 3D acoustic renderer 120 in the stereophonic audio reproducing 100, according to an embodiment.

Referring to FIG. 2, according to an embodiment, the stereophonic audio reproducing apparatus 100 is shown based on a configuration of the decoder 110 and the 3D acoustic renderer 120, and other configurations are omitted.

An audio signal input to the stereophonic audio reproducing apparatus 100 is an encoded signal and is input in a bitstream format. The decoder 110 decodes the input audio signal by selecting a decoder tool suitable for a scheme by which the audio signal was encoded and transmits the decoded audio signal to the 3D acoustic renderer 120.

If elevated rendering is performed, a virtual 3D elevated sound image may be obtained by a 5.1 channel layout including only horizontal channels. Such an elevated rendering algorithm includes a spatial tone color filtering and spatial location panning process.

The 3D acoustic renderer 120 includes an initialization unit 121 for obtaining and updating a filter coefficient and a panning coefficient and a rendering unit 123 for performing filtering and panning.

The rendering unit 123 performs filtering and panning on the audio signal transmitted from the core decoder 110. A spatial tone color filtering unit 1231 processes information about a location of a sound so that a rendered audio signal is reproduced at a desired location. A spatial location panning unit 1232 processes information about a tone of the sound so that the rendered audio signal has a tone suitable for the desired location.

The spatial tone color filtering unit 1231 is designed to correct a tone of sound based on head-related transfer function (HRTF) modeling and reflects a difference of a path through which an input channel spreads to an output channel. For example, the spatial tone color filtering unit 1231 may correct a tone of sound to amplify energy with respect to a signal of a frequency band of 1~10 kHz and reduce energy with respect to other frequency bands, thereby obtaining a more natural tone of sound.

The spatial location panning unit 1232 is designed to provide an overhead sound image through multi-channel panning. Different panning coefficients (gain) are applied to input channels. Although the overhead sound image may be obtained by performing spatial location panning, a similarity between channels may increase, which increase correlations of all audio scenes. When virtual rendering is performed on a highly uncorrelated audio scene, a rendering type may be determined based on a characteristic of an audio scene in order to prevent rendering quality from deteriorating.

Alternatively, when an audio signal is produced, a rendering type may be determined according to an intention of an audio signal producer (creator). In this case, the audio signal producer may manually determine information regarding the rendering type of the audio signal and may include a parameter for determining the rendering type in the audio signal.

For example, an encoder generates additional information such as rendering3DType that is a parameter for determining a rendering type in an encoded data frame and transmits the additional information to the decoder 110. The decoder 110 may acknowledge rendering3DType information, if rendering3DType indicates a 3D rendering type, perform spatial tone color filtering and spatial location panning, and, if rendering3DType indicates a 2D rendering type, perform spatial tone color filtering and general panning.

In this regard, general panning may be performed on a multi-channel signal based on azimuth angle information without considering elevation angle information of an input audio signal. The audio signal to which general panning is performed does not provide a sound image having a sense of elevation, and thus a 2D sound image on a horizontal plane is transferred to a user.

Spatial location panning applied to 3D rendering may have different panning coefficients for each frequency.

In this regard, a filter coefficient to be used for filtering and a panning coefficient to be used for panning are transmitted from the initialization unit 121. The initialization unit 121 includes an elevation rendering parameter obtaining unit 1211 and an elevation rendering parameter update unit 1212.

The elevation rendering parameter obtaining unit 1211 obtains an initialization value of an elevation rendering parameter by using a configuration and a layout of output channels, i.e., loudspeakers. In this regard, the initialization value of the elevation rendering parameter is calculated based on a configuration of output channels according to a standard layout and a configuration of input channels according to an elevation rendering setup, or for the initialization value of the elevation rendering parameter, a pre-stored initialization value is read according to a mapping relationship between input/output channels. The elevation rendering parameter may include a filter coefficient to be used by the spatial tone color filtering unit 1231 or a panning coefficient to be used by the spatial location panning unit 1232.

However, as described above, a deviation between a set elevation value for the elevation rendering and settings of input channels may exist. In this case, when a fixed set elevation value is used, it is difficult to achieve the purpose of virtual rendering of an 3D audio signal to reproduce the 3D audio signal more similar to original sound of the 3D audio signal through output channels having a different configuration from that of input channels.

For example, when a sense of elevation is too high, a phenomenon in which an audio image is small and sound quality is deteriorated may occur, and when a sense of elevation is too low, a problem that it is difficult to feel an effect of virtual rendering may occur. Therefore, it is necessary to adjust a sense of elevation according to settings of a user or a degree of virtual rendering suitable for an input channel.

The elevation rendering parameter update unit 1212 updates the elevation rendering parameter by using initialization values of the elevation rendering parameter, which are obtained by the elevation rendering parameter obtaining unit 1211, based on elevation information of an input channel or a user's set elevation. In this regard, if a speaker layout of output channels has a deviation as compared with the standard layout, a process for correcting an influence according to the deviation may be added. The output channel deviation may include deviation information according to an elevation angle difference or an azimuth angle difference.

An output audio signal filtered and panned by the rendering unit 123 by using the elevation rendering parameter obtained and updated by the initialization unit 121 is reproduced through a speaker corresponding to each output channel.

Figure 3:
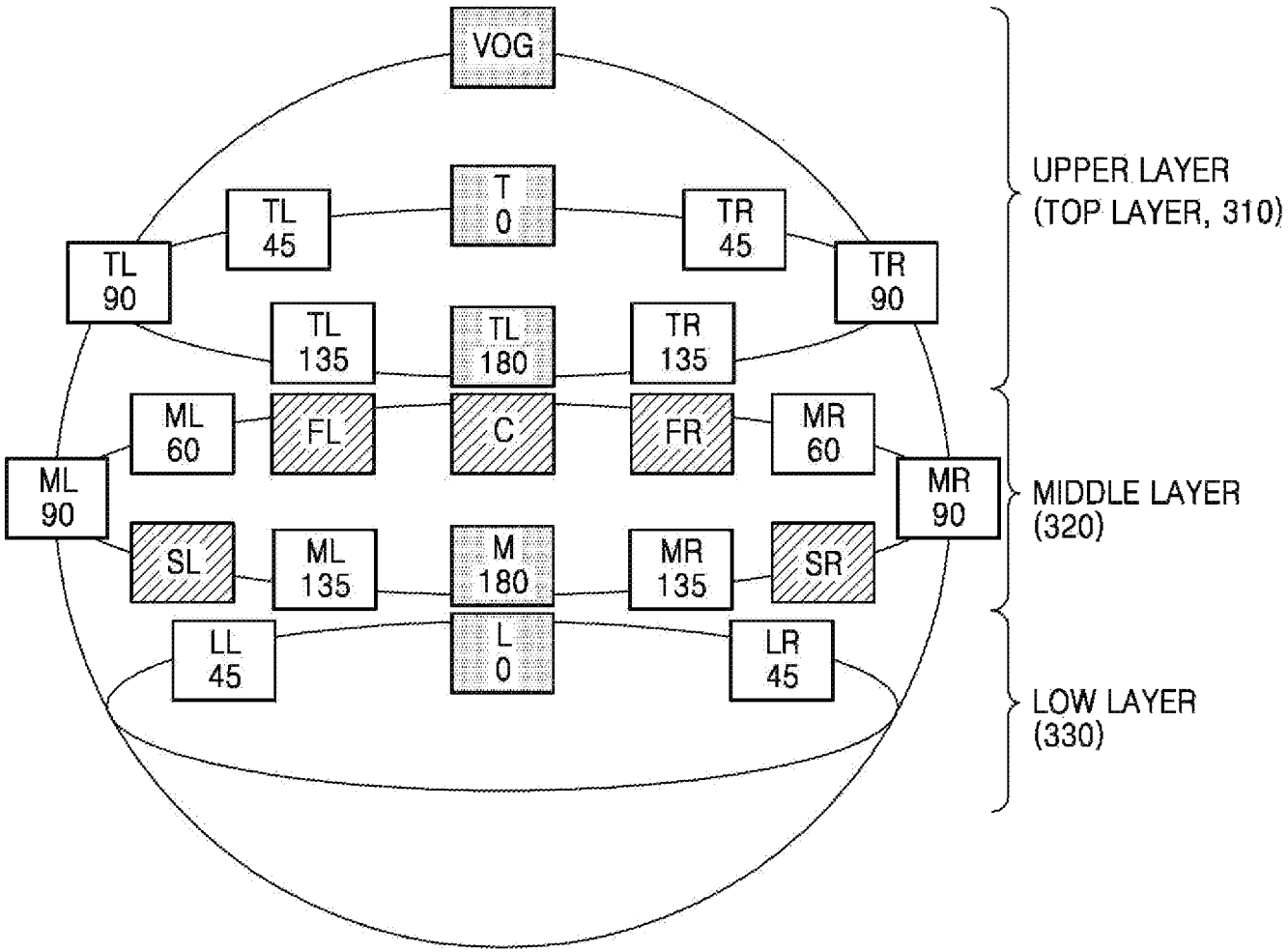
FIG. 3 illustrates a layout of channels when a plurality of input channels are down-mixed to a plurality of output channels, according to an embodiment.

FIG. 3 illustrates a layout of channels when a plurality of input channels are down-mixed to a plurality of output channels according to an embodiment.

To provide the same or a more exaggerated sense of realism and sense of immersion as reality as in a 3D image, techniques for providing a 3D stereophonic sound together with a 3D stereoscopic image have been developed. A stereophonic sound indicates a sound in which an audio signal itself gives a sense of elevation and a sense of space of a sound, and to reproduce such a stereophonic sound, at least two loudspeakers, i.e., output channels, are necessary. In addition, except for a binaural stereophonic sound using the HRTF, a greater number of output channels are necessary to more accurately reproduce a sense of elevation, a sense of distance, and a sense of space of a sound.

Therefore, a stereo system having two output channels and various multi-channel systems such as a 5.1-channel system, an Auro 3D system, a Holman 10.2-channel system, an ETRI/Samsung 10.2-channel system, and an NHK 22.2-channel system have been proposed and developed.

FIG. 3 illustrates a case where a 22.2-channel 3D audio signal is reproduced by a 5.1-channel output system.

A 5.1-channel system is a general name of a five-channel surround multi-channel sound system and is the system most popularly used as home theaters and cinema sound systems. A total of 5.1 channels include a front left (FL) channel, a center (C) channel, a front right (FR) channel, a surround left (SL) channel, and a surround right (SR) channel. As shown in FIG. 3, since all outputs of the 5.1 channels are on the same plane, the 5.1-channel system physically corresponds to a 2D system, and to reproduce a 3D audio signal by using the 5.1-channel system, a rendering process for granting a 3D effect to a signal to be reproduced must be performed.

The 5.1-channel system is widely used in various fields of not only the movie field but also the DVD image field, the DVD sound field, the super audio compact disc (SACD) field, or the digital broadcasting field. However, although the 5.1-channel system provides an improved sense of space as compared to a stereo system, there are several limitations in forming a wider listening space compared to a multi-channel audio presentation method such as in a 22.2 channel system. In particular, since a sweet spot is formed to be narrow when virtual rendering is performed and a vertical audio image having an elevation angle cannot be provided when general rendering is performed, the 5.1-channel system may not be suitable for a wide listening space such as in a cinema.

The 22.2-channel system proposed by NHK includes three-layer output channels, as shown in FIG. 3. An upper layer 310 includes a voice of god (VOG) channel, a T0 channel, a T180 channel, a TL45 channel, a TL90 channel, a TL135 channel, a TR45 channel, a TR90 channel, and a TR45 channel. Herein, an index T that is the first character of each channel name indicates an upper layer, indices L and R indicate the left and the right, respectively, and the number after the letters indicates an azimuth angle from the center channel. The upper layer is usually called a top layer.

The VOG channel is a channel existing above the heads of an audience, has an elevation angle of 90°, and has no azimuth angle. However, when the VOG channel is wrongly located even a little, the VOG channel has an azimuth angle and an elevation angle that is different from 90°, and thus the VOG channel may not act as the VOG channel any more.

A middle layer 320 is on the same plane as the existing 5.1 channels and includes an ML60 channel, an ML90 channel, an ML135 channel, an MR60 channel, an MR90 channel, and an MR135 channel besides the output channels of the 5.1 channels. In this regard, an index M that is the first character of each channel name indicates a middle layer, and the following number indicates an azimuth angle from the center channel.

A low layer 330 includes an L0 channel, an LL45 channel, and an LR45 channel. In this regard, an index L that is the first character of each channel name indicates a low layer, and the following number indicates an azimuth angle from the center channel.

In the 22.2 channels, the middle layer is called a horizontal channel, and the VOG, T0, T180, M180, L, and C channels corresponding to an azimuth angle of 0° or 180° are called vertical channels.

When a 22.2-channel input signal is reproduced using a 5.1-channel system, according to the most general method, an inter-channel signal can be distributed using a down-mix expression. Alternatively, rendering for providing a virtual sense of elevation may be performed so that the 5.1-channel system reproduces an audio signal having a sense of elevation.

Figure 4:
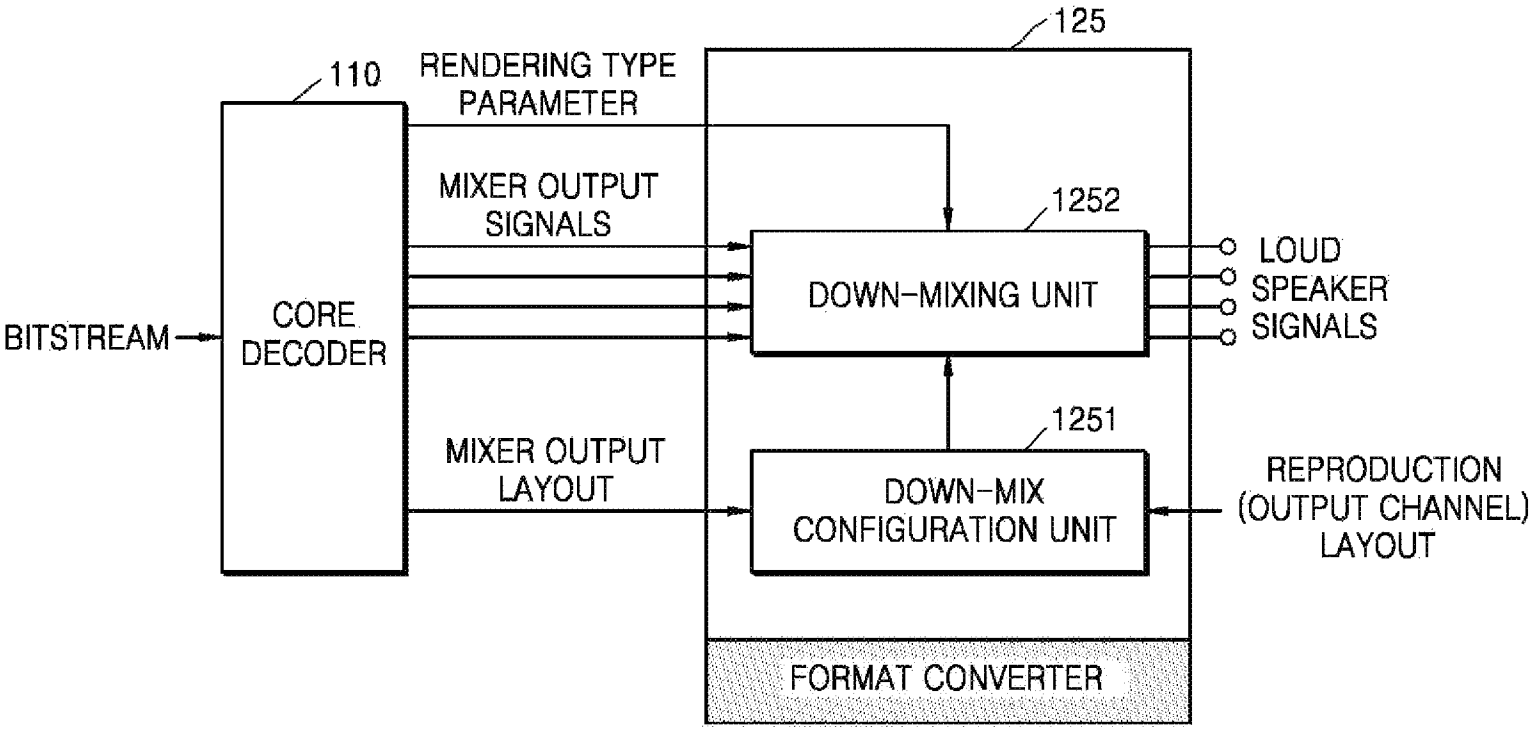
FIG. 4 is a block diagram of main components of a renderer format converter according to an embodiment.

FIG. 4 is a block diagram of main components of a renderer according to an embodiment.

A renderer is a down-mixer that converts a multi-channel input signal having Nin channels into a reproduction format having Nout channels and is called a format converter. In this regard, Nout<Nin. FIG. 4 is a block diagram of main components of a format converter configured from a renderer with respect to down-mixing.

An encoded audio signal is input to the core decoder 110 in a bitstream format. The signal input to the core decoder 110 is decoded by a decoder tool suitable for an encoding scheme and is input to a format converter 125.

The format converter 125 includes two main blocks. A first main block is a down-mix configuring unit 1251 that performs initialization algorithm that is responsible for static parameters such as input and output formats. A second main block is a down-mixing unit 1252 that down-mixes a mixer output signal based on a down-mix parameter obtained by using the initialization algorithm.

The down-mix configuring unit 1251 generates the down-mix parameter that is optimized based on a mixer output layout corresponding to a layout of an input channel signal and a reproduction layout corresponding to a layout of an output channel. The down-mixer parameter may be a down-mix matrix and is determined by an available combination of given input format and output channel.

In this regard, an algorithm that selects an output loudspeaker (output channel) is applied to each input channel by the most suitable mapping rule included in a mapping rule list in consideration of psychological audio. A mapping rule is designed to map one input channel to one output loudspeaker or a plurality of output loudspeakers.

An input channel may be mapped to one output channel or may be panned to two output channels. An input channel such as a VOG channel may be distributed to a plurality of output channels. Alternatively, an input signal may be panned to a plurality of output channels having different panning coefficients according to frequencies and immersively rendered to give a sense of ambience. An output channel only having a horizontal channel such as a 5.1 channel needs to have a virtual elevation (height) channel in order to give a sense of ambience, and thus elevation rendering is applied to the output channel.

Optimal mapping of each input channel is selected according to a list of output loudspeakers that are likely to be rendered in a desired output format. A generated mapping parameter may include not only a down-mix gain with respect to an input channel but also an equalizer (tone color filter) coefficient.

During a process of generating the down-mix parameter, when an output channel goes beyond a standard layout, for example, when the output channel has not only an elevation or azimuth deviation but also a distance deviation, a process of updating or correcting the down-mix parameter in consideration of this may be added.

The down-mixing unit 1252 determines a rendering mode according to a parameter that determines a rendering type included in an output signal of the core decoder 110 and down-mixes a mixer output signal of the core decoder 110 according to the determined rendering mode. In this regard, the parameter that determines the rendering type may be determined by an encoder that encodes a multi-channel signal and may be included in the multi-channel signal decoded by the core decoder 110.

The parameter that determines the rendering type may be determined for each frame of an audio signal and may be stored in a field of a frame that displays additional information. If the number of rendering types that are likely to be rendered by a renderer is limited, the parameter that determines the rendering type may be possible as a small bit number and, for example, if two rendering types are displayed, may be configured as a flag having 1 bit.

The down-mixing unit 1252 performs down-mixing in a frequency region and a hybrid quadrature mirror filter (QMF) subband region, and, in order to prevent deterioration of a signal due to a defect of comb filtering, coloration, or signal modulation, performs phase alignment and energy normalization.

Phase alignment is a process of adjusting phases of input signals that have correlation but different phases before down-mixing the input signals. The phase alignment process aligns only related channels with respect to related time-frequency tiles and does not need to change any other part of an input signal. It should be noted to prevent a defect during phase alignment since a phase correction interval quickly changes for alignment.

If the phase alignment process is performed, a narrow spectral pitch that occurs due to a limited frequency resolution and that cannot be compensated for through energy normalization may be avoided, and thus quality of an output signal may be improved. Also, there is no need to amplify a signal during energy preservation normalization, and thus a modulation defect may be reduced.

In elevation rendering, phase alignment is not performed for accurate synchronization of a rendered multi-channel signal with respect to an input signal of a high frequency band.

During down-mixing, energy normalization is performed to preserve input energy and is not performed when a down-mix matrix itself performs energy scaling.

Figure 5:
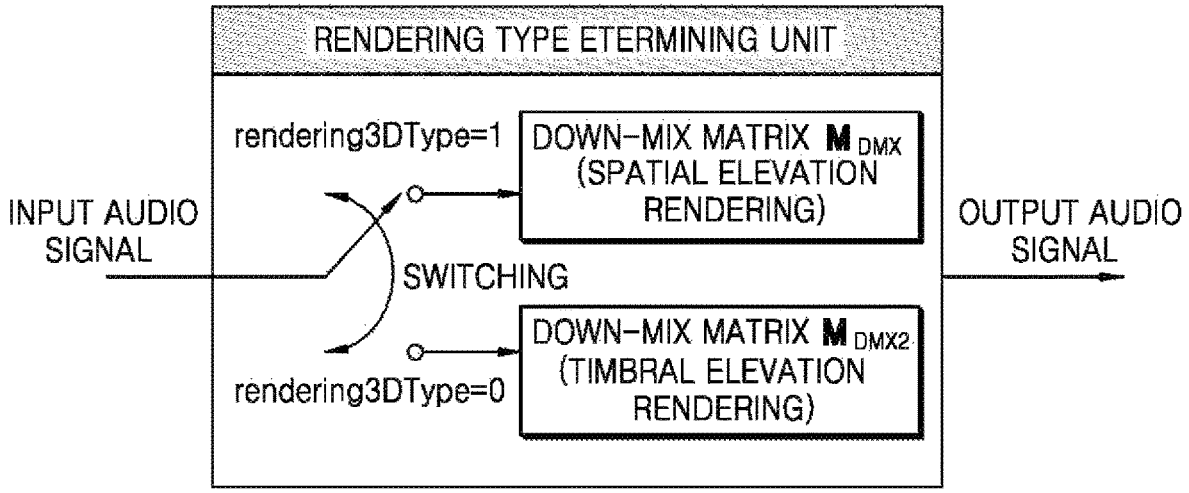
FIG. 5 illustrates a configuration of a selector that selects a rendering type and a down-mix matrix based on a rendering type determination parameter, according to an embodiment.

FIG. 5 illustrates a configuration of a selector that selects a rendering type and a down-mix matrix based on a rendering type determination parameter, according to an embodiment.

According to an embodiment, the rendering type is determined based on a parameter that determines the rendering type and rendering is performed according to the determined rendering type. If the parameter that determines the rendering type is a flag rendering3DType having a size of 1 bit, the selector operates to perform 3D rendering if rendering3DType is 1(TRUE) and perform 2D rendering if rendering3DType is 0(FALSE) and is switched according to a value of rendering3DType.

In this regard, M_DMX is selected as a down-mix matrix for 3D rendering, and M_DMX2 is selected as a down-mix matrix for 2D rendering. Each of the down-mix matrixes M_DMX and M_DMX2 is selected by the initialization unit 121 of FIG. 2 or the down-mix configuring unit 1251 of FIG. 4. M_DMX is a basic down-mix matrix for spatial elevation rendering including a down-mix coefficient (gain) that is a non-negative real number. A size of M_DMX is (Nout×Nin) where Nout denotes the number of output channels and Nin denotes the number of input channels. M_DMX2 is a basic down-mix matrix for timbral elevation rendering including a down-mix coefficient (gain) that is a non-negative real number. A size of M_DMX2 is (Nout×Nin) like M_DMX.

An input signal is down-mixed for each hybrid QMF frequency subband by using a down-mix matrix suitable for each rendering type according to a selected rendering type.

FIG. 6 illustrates a syntax that determines a rendering type configuration based on a rendering type determination parameter according to an embodiment.

In the same manner as shown in FIG. 5, a parameter that determines a rendering type is a flag rendering3Dtype having a size of 1 bit, and RenderingTypeConfig( )defines an appropriate rendering type for a format conversion.

rendering3Dtype may be generated by an encoder. In this regard, rendering3Dtype may be determined based on an audio scene of an audio signal. If the audio scene is a wideband signal or is a highly decorrelated signal such as sound of rain or sound of applause, etc. rendering3Dtype is FALSE, and thus multichannel signal is down-mixed by using M_DMX2 that is a down-mix matrix for 2D rendering. In other cases, rendering3Dtype is TRUE with respect to a general audio scene, and thus multichannel signal is down-mixed by using M_DMX that is a down-mix matrix for 3D rendering.

Alternatively, rendering3Dtype may be determined according to an intention of an of an audio signal producer (creator). The creator down-mixes an audio signal (frame) set to perform 2D rendering by using M_DMX2 that is a down-mix matrix for 2D rendering. In other cases, rendering3Dtype is TRUE with respect to a general audio scene, and thus the creator down-mixes an audio signal (frame) by using M_DMX that is a down-mix matrix for 3D rendering.

In this regard, when 3D rendering is performed, both spatial tone color filtering and spatial location panning are performed, whereas, when 2D rendering is performed, only spatial tone color filtering is performed.

Figure 7:
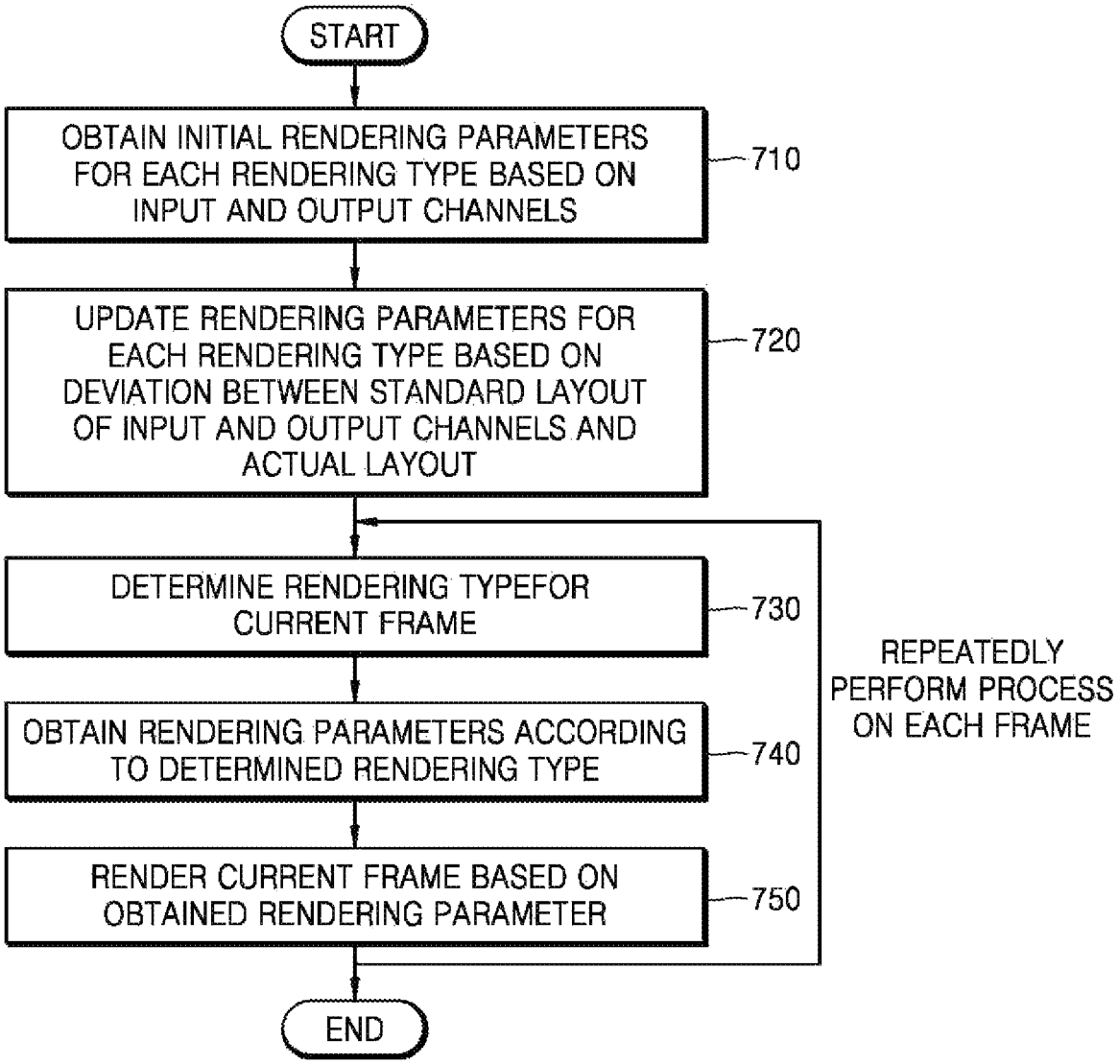
FIG. 7 is a flowchart of a method of rendering an audio signal, according to an embodiment.

FIG. 7 is a flowchart of a method of rendering an audio signal according to an embodiment.

If a multi-channel signal decoded by the core decoder 110 is input to the format converter 125 or the renderer 120, an initialization value of a rendering parameter is obtained based on a standard layout of input channels and output channels (operation 710). In this regard, the obtained initialization value of the rendering parameter may be differently determined according to a rendering type that is likely to be rendered by the renderer 120 and may be stored in a non-volatile memory such as a read only memory (ROM) of an audio signal reproduction system.

An initialization value of an elevation rendering parameter is calculated based on a configuration of output channels according to a standard layout and a configuration of input channels according to an elevation rendering setup, or for the initialization value of the elevation rendering parameter, a pre-stored initialization value is read according to a mapping relationship between input/output channels. The elevation rendering parameter may include a filter coefficient to be used by the spatial tone color filtering unit 1231 of FIG. 2 or a panning coefficient to be used by the spatial location panning unit 1232 of FIG. 2.

In this regard, if layouts of the input/output channels are identical to all standard layouts, rendering may be performed by using the initialization value of the rendering parameter obtained in 710. However, when a deviation between a set elevation value for rendering and settings of input channels exists or a deviation between a layout in which a loudspeaker is actually installed and a standard layout of output channels exists, if the initialization value obtained in operation 710 is used for rendering as it is, a phenomenon in which a distorted or rendered signal of a sound image is output in a location that is not an original location occurs.

Therefore, the rendering parameter is updated based on a deviation between the standard layout of the input/output channels and an actual layout (operation 720). In this regard, the updated rendering parameter may be differently determined according to a rendering type that is likely to be rendered by the renderer 120.

The updated rendering parameter may have a matrix format having a size of Nin×Nout for each hybrid QMF subband according to each rendering type. Nin denotes the number of input channels. Nout denotes the number of output channels. In this regard, a matrix presenting the rendering parameter is called a down-mix matrix. M_DMX denotes a down-mix matrix for 3D rendering. M_DMX2 denotes a down-mix matrix for 2D rendering.

If the down-mix matrixes M_DMX and M_DMX2 are determined, a rendering type suitable for a current frame is determined based on a parameter that determines the rendering type (operation 730).

The parameter that determines the rendering type may be included in a bitstream inputted to a core decoder by being generated when an encoder encodes an audio signal. The parameter that determines the rendering type may be determined according to a characteristic of an audio scene of the current frame. When the audio signal has many transient signals such as the sound of applause or the sound of rain, since there are many instant and temporary signals, the audio scene has a characteristic of a low correlation between channels.

When a highly decorrelated signal between channels or a atonal wideband signal in a plurality of input channels exists, levels of signals are similar for each channel, or an impulse shape of a short section is repeated, if a signal of a plurality of channels is down-mixed to one channel, a "phaseyness" phenomenon in which an offset effect occurs because of a frequency mutual interference so that a tone of sound changes and a tone color distortion phenomenon in which the number of transient signals for one channel increases so that sound whitening occurs.

In this case, it may be preferable to perform timbral elevation rendering as 2D rendering, rather than spatial elevation rendering as 3D rendering.

Therefore, as a result of analyzing the characteristic of the audio scene, the rendering type may be determined as a 3D rendering type in a normal case, and the rendering type may be determined as a 2D rendering type if a wideband signal exists or a highly decorrelated signal between channels exists.

If the rendering type suitable for the current frame is determined, a rendering type based on the determined rendering type is obtained (operation 740). The current frame is rendered based on the obtained rendering type (operation 750).

If the determined rendering type is a 3D rendering type, a storage unit that stores the down-mix matrix may obtain M_DMX that is the down-mix matrix for 3D rendering. The down-mix matrix M_DMX down-mixes a signal of Nin input channels with respect to one hybrid QMF subband to Nout output channels by using a matrix having a size of Nin×Nout for each hybrid QMF subband.

If the determined rendering type is a 2D rendering type, a storage unit that stores the down-mix matrix may obtain M_DMX2 that is the down-mix matrix for 2D rendering. The down-mix matrix M_DMX2 down-mixes a signal of Nin input channels with respect to one hybrid QMF subband to Nout output channels by using a matrix having a size of Nin×Nout for each hybrid QMF subband.

A process of determining the rendering type suitable for the current frame (operation 730), obtaining the rendering type based on the determined rendering type (operation 740), and rendering the current frame based on the obtained rendering type (operation 750) is performed for each frame repeatedly until an input of the multi-channel signal decoded by the core decoder ends.

Figure 8:
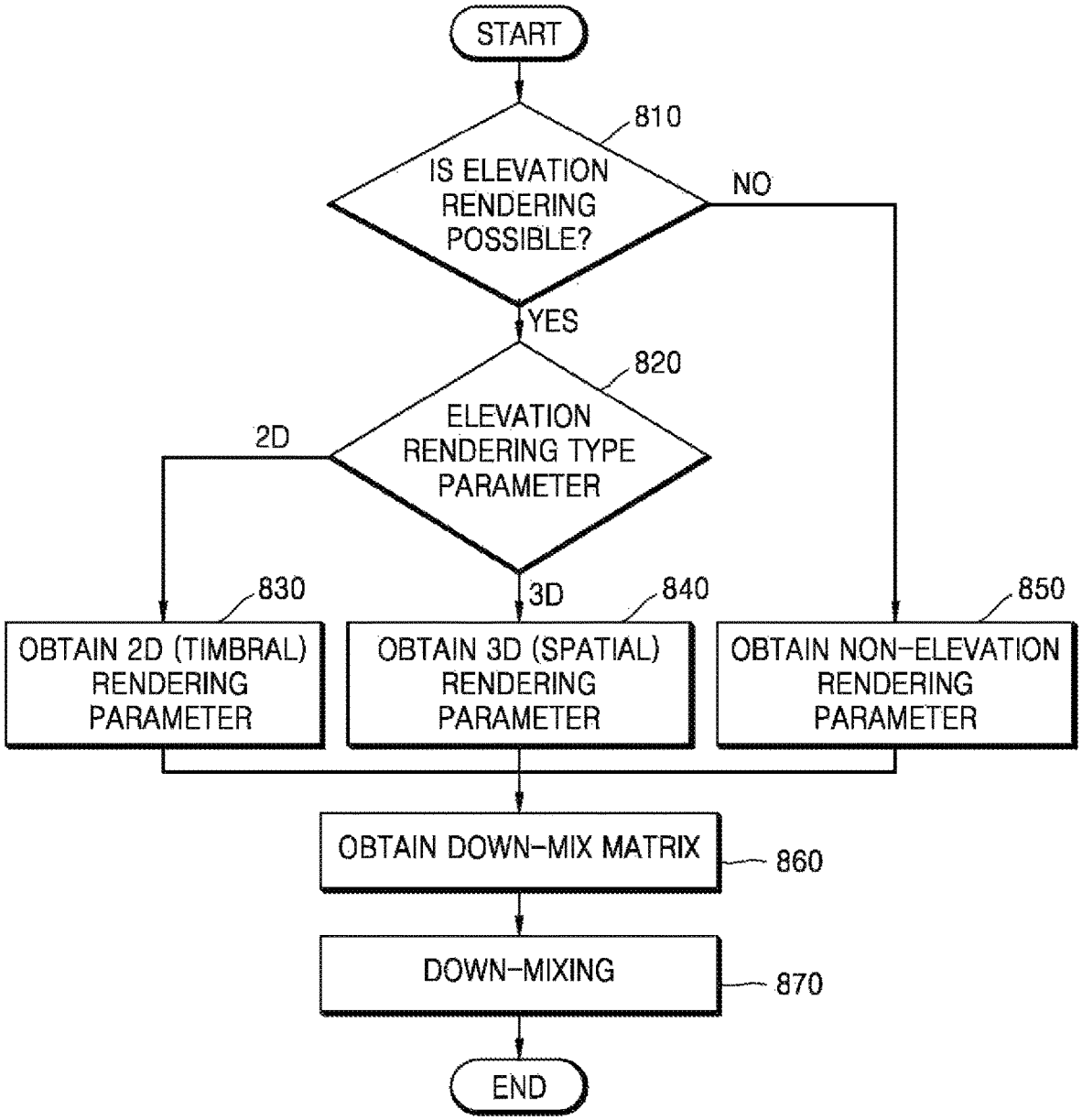
FIG. 8 is a flowchart of a method of rendering an audio signal based on a rendering type, according to an embodiment.

FIG. 8 is a flowchart of a method of rendering an audio signal based on a rendering type according to an embodiment.

In the embodiment of FIG. 8, operation 810 of determining whether elevation rendering is possible from a relationship between input/output channels is added.

Whether elevation rendering is possible is determined based on a priority of down-mix rules according to input channels and a reproduction layout.

If elevation rendering is not performed based on the priority of down-mix rules according to input channels and the reproduction layout, a rendering parameter for non-elevation rendering is obtained (operation 850) in order to perform non-elevation rendering.

If elevation rendering is possible as a result of determination in operation 810, a rendering type is determined from an elevation rendering type parameter (operation 820). If the elevation rendering type parameter indicates 2D rendering, the rendering type is determined as a 2D rendering type, and a 2D rendering parameter for 2D rendering is obtained (operation 830). Meanwhile, if the elevation rendering type parameter indicates 3D rendering, the rendering type is determined as a 3D rendering type, and a 3D rendering parameter for 3D rendering is obtained (operation 840).

The rendering parameter obtained through a process described above is a rendering parameter for one input channel. A rendering parameter for each channel is obtained by repeating the same process on each input channel and is used to obtain all down-mix matrixes with respect to all input channels (operation 860). A down-mix matrix is a matrix for rendering the input signal by down-mixing an input channel signal to an output channel signal and has a size of Nin×Nout for each hybrid QMF subband.

If the down-mix matrix is obtained, the input channel signal is down-mixed by using the obtained down-mix matrix (operation 870) to generate a output signal.

If the elevation rendering type parameter exists for each frame of a decoded signal, a process of operations 810 to 870 of FIG. 8 is repeatedly performed for each frame. If the process on a last frame is finished, an entire rendering process ends.

In this regard, when non-elevation rendering is performed, active down-mixing is performed on all frequency bands. When elevation rendering is performed, phase alignment is performed on only a low frequency band and is not performed on a high frequency band. Phase alignment is not performed on the high frequency band because of an accurate synchronization of a rendered multi-channel signal as described above.

Figure 9:
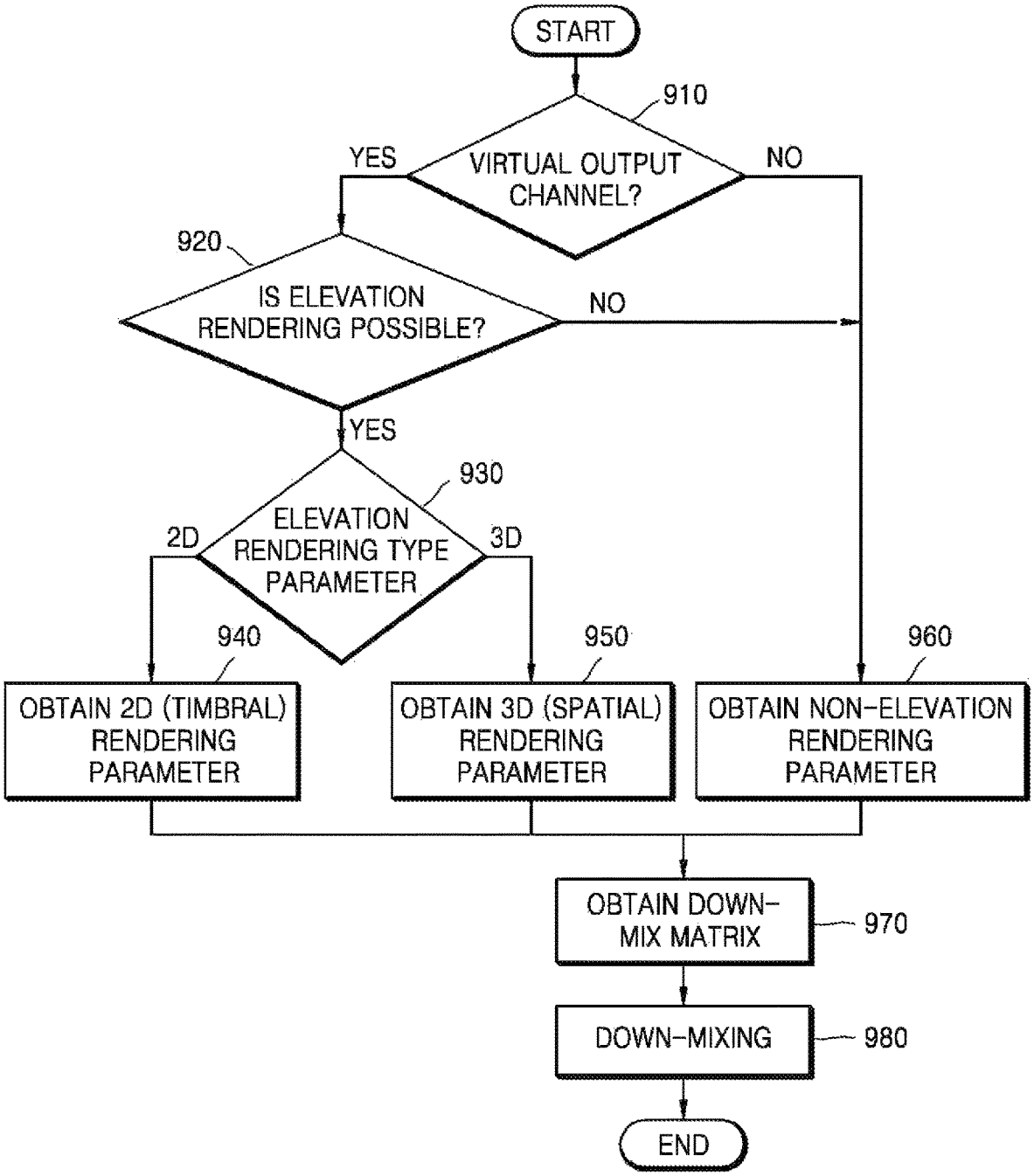
FIG. 9 is a flowchart of a method of rendering an audio signal based on a rendering type, according to another embodiment.

FIG. 9 is a flowchart of a method of rendering an audio signal based on a rendering type according to another embodiment.

In the embodiment of FIG. 9, operation 910 of determining whether an output channel is a virtual channel is added. If the output channel is not the virtual channel, since it is unnecessary to perform elevation rendering or virtual rendering, non-elevation rendering is performed based on a priority of valid down-mix rules. Thus, a rendering parameter for non-elevation rendering is obtained (operation 960) in order to perform non-elevation rendering.

If the output channel is the virtual channel, whether elevation rendering is possible is determined from a relationship between input/output channels (operation 920). Whether elevation rendering is possible is determined based on a priority of down-mix rules according to input channels and a reproduction layout.

If elevation rendering is not performed based on the priority of down-mix rules according to input channels and the reproduction layout, a rendering parameter for non-elevation rendering is obtained (operation 960) in order to perform non-elevation rendering.

If elevation rendering is possible as a result of determination in operation 920, a rendering type is determined from an elevation rendering type parameter (operation 930). If the elevation rendering type parameter indicates 2D rendering, the rendering type is determined as a 2D rendering type, and a 2D rendering parameter for 2D rendering is obtained (operation 940). Meanwhile, if the elevation rendering type parameter indicates 3D rendering, the rendering type is determined as a 3D rendering type, and a 3D rendering parameter for 3D rendering is obtained (operation 950).

2D rendering and 3D rendering are respectively used together with timbral elevation rendering and spatial elevation rendering.

The rendering parameter obtained through a process described above is a rendering parameter for one input channel. A rendering parameter for each channel is obtained by repeating the same process on each input channel and is used to obtain all down-mix matrixes with respect to all input channels (operation 970). A down-mix matrix is a matrix for rendering the input signal by down-mixing an input channel signal to an output channel signal and has a size of Nin×Nout for each hybrid QMF subband.

If the down-mix matrix is obtained, the input channel signal is down-mixed by using the obtained down-mix matrix (operation 980) to generate a output signal.

If the elevation rendering type parameter exists for each frame of a decoded signal, a process of operations 910 to 980 of FIG. 9 is repeatedly performed for each frame. If the process on a last frame is finished, an entire rendering process ends.

The above-described embodiments of the present invention may be implemented as computer instructions which may be executed by various computer means, and recorded on a computer-readable recording medium. The computer-readable recording medium may include program commands, data files, data structures, or a combination thereof. The program commands recorded on the computer-readable recording medium may be specially designed and constructed for the present invention or may be known to and usable by those of ordinary skill in a field of computer software. Examples of the computer-readable medium include magnetic media such as hard discs, floppy discs, and magnetic tapes, optical recording media such as compact CD-ROMs, and DVDs, magneto-optical media such as floptical discs, and hardware devices that are specially configured to store and carry out program commands, such as ROMs, RAMs, and flash memories. Examples of the program commands include a high-level language code that may be executed by a computer using an interpreter as well as a machine language code made by a complier. The hardware devices may be changed to one or more software modules to perform processing according to the present invention, and vice versa.

While the present invention has been described with reference to specific features such as detailed components, the limited embodiments, and the drawings, they are provided only to assist the general understanding of the present invention, and the present invention is not limited to the embodiments, and those of ordinary skill in the art to which the present invention belongs may perform various changes and modifications of the embodiments described herein.

Therefore, the idea of the present invention should not be defined only by the embodiments described above, and the appended claims, their equivalents, or all the scopes equivalently changed therefrom belong to the scope of the idea of the present invention.

What is claimed is:

1. A method of rendering an audio signal, the method comprising:

receiving a plurality of input channel signals including a height input channel signal;

determining whether an output channel, corresponding to an input channel signal among the plurality of input channel signals, is a virtual channel;

determining whether elevation rendering is possible based on a mapping relation between the input channel signal and a plurality of output channel signals;

when the output channel corresponding to the input channel signal is the virtual channel and the elevation rendering is possible, obtaining an elevation rendering parameter;

when the output channel corresponding to the input channel signal is not the virtual channel, obtaining a non-elevation rendering parameter;

obtaining a first downmix matrix and a second downmix matrix, based on at least one of the elevation rendering parameter and the non-elevation rendering parameter; and rendering the plurality of input channel signals into the plurality of output channel signals using one of the first downmix matrix and the second downmix matrix selected according to the additional information, wherein the plurality of output channel signals are outputted from a plurality of loudspeakers, and wherein an output format of the plurality of output channel signals is a 5.1 channel format, and an elevation angle of output channel signal and an elevation angle of the height input channel signal are different.

2. The method of claim 1, wherein the first downmix matrix is for 3D rendering, and the second downmix matrix is for two-dimensional (2D) rendering.

3. The method of claim 2, further comprising:

receiving a bitstream including a rendering3DType;

when the rendering3DType is true, selecting the first downmix matrix, and when the rendering3DType is false, selecting the second downmix matrix.

4. An apparatus for rendering an audio signal, the apparatus comprising:

a receiving unit configured to receive a plurality of input channel signals including a height input channel signal; and at least one processor configured to:

determine whether an output channel, corresponding to an input channel signal among the plurality of input channel signals, is a virtual channel, determine whether elecation rendering is possible based on a mapping relation between the input channel signal and a plurality of output channel signals, when the output channel corresponding to the input channel signal is the virtual channel and the elevation rendering is possible, obtain an elevation rendering parameter;

when the output channel corresponding to the input channel signal is not the virtual channel, obtain a non-elevation rendering parameter;

obtain a first downmix matrix and a second downmix matrix, based on at least one of the elevation rendering parameter and the non-elevation rendering parameter; and render the plurality of input channel signals into the plurality of output channel signals using one of the first downmix matrix and the second downmix matrix selected according to the additional information, wherein the plurality of output channel signals are outputted from a plurality of loudspeakers, and wherein an output format of the plurality of output channel signals is a 5.1 channel format, and an elevation angle of output channel signal and an elevation angle of the height input channel signal are different.

5. The apparatus of claim 4, wherein the first downmix matrix is for 3D rendering, and the second downmix matrix is for two-dimensional (2D) rendering.

6. The apparatus of claim 5, wherein the receiving unit is further configured to receive a bitstream including a rendering3DType; and the at least one processor is further configured to select the first downmix matrix when the rendering3DType is true, and select the second downmix matrix when the rendering3DType is false.

7. A non-transitory computer-readable recording medium having recorded thereon a program which, when executed by a processor of an apparatus for rendering an audio signal, cause the apparatus to perform the method of claim 1.

* * * * *